US011226123B2

(12) United States Patent
Nani

(10) Patent No.: US 11,226,123 B2
(45) Date of Patent: Jan. 18, 2022

(54) INDUCTIVE-HUMIDIFICATION AND EVAPORATIVE-COOLING VENTILATION SYSTEM

(71) Applicant: AERIS GROUP HOLDING S.R.L., Clusone (IT)

(72) Inventor: Eros Nani, Ciserano (IT)

(73) Assignee: AERIS GROUP HOLDING S.R.L., Clusone (IT)

( * ) Notice: Subject to any disclaimer, the term of this patent is extended or adjusted under 35 U.S.C. 154(b) by 142 days.

(21) Appl. No.: 16/516,560

(22) Filed: Jul. 19, 2019

(65) Prior Publication Data

US 2020/0041148 A1 Feb. 6, 2020

(30) Foreign Application Priority Data

Jul. 31, 2018 (IT) ..... 102018000007680

(51) Int. Cl.

| | |
|---|---|
| ***F24F 5/00*** | (2006.01) |
| ***F24F 3/14*** | (2006.01) |
| ***F24F 6/14*** | (2006.01) |

(52) U.S. Cl.

CPC ..... *F24F 5/0035* (2013.01); *F24F 3/14* (2013.01); *F24F 6/14* (2013.01); *F24F 2006/143* (2013.01)

(58) Field of Classification Search

CPC ..... F24F 5/0035; F24F 6/14; F24F 2006/143
See application file for complete search history.

(56) References Cited

U.S. PATENT DOCUMENTS

| | | | | |
|---|---|---|---|---|
| 4,429,735 | A * | 2/1984 | Nomaguchi | B05B 17/0615 165/60 |
| 5,857,350 | A * | 1/1999 | Johnson | F28D 5/00 62/314 |
| 2017/0023268 | A1* | 1/2017 | Chan | F24F 6/14 |

FOREIGN PATENT DOCUMENTS

| | | | |
|---|---|---|---|
| DE | 1052093 | B | 3/1959 |
| FR | 1411179 | A | 9/1965 |
| FR | 2847968 | A1 | 6/2004 |
| GB | 901678 | A | 7/1962 |
| SE | 212099 | C1 | 1/1966 |

(Continued)

OTHER PUBLICATIONS

SE212099C1 Translation (Year: 1967).*
English Machine Translation of DE1052093B dated Mar. 5, 1959.
English Machine Translation of FR1411179A dated Sep. 17, 1965.

*Primary Examiner* — Schyler S Sanks
(74) *Attorney, Agent, or Firm* — Dickinson Wright PLLC; Andrew D. Dorisio

(57) ABSTRACT

An inductive-humidification and evaporative-cooling ventilation system comprising: means for generating a flow of air; a channel for conveying said flow of air, said channel comprising a plurality of inductive holes for transferring said flow of air into the environment, said channel further comprising at least one outflow mouth for expelling said flow of air, which has a three-dimensional structure open both at the back and at the front, and a fluid-thread straightener set at the rear end of said at least one outflow mouth, which recalls a flow of air from the environment surrounding said channel; and at least one humidification device for introducing nebulised water into the environment; wherein said at least one humidification device is set within said at (Continued)

least one diffusion mouth, and said plurality of holes are arranged in a number of rows aligned longitudinally along the ducts.

10 Claims, 1 Drawing Sheet

(56) References Cited

FOREIGN PATENT DOCUMENTS

| | | | | |
|---|---|---|---|---|
| SE | 212099 | C1 | * | 4/1967 |
| WO | 9315366 | A1 | | 8/1993 |

* cited by examiner

INDUCTIVE-HUMIDIFICATION AND EVAPORATIVE-COOLING VENTILATION SYSTEM

This application claims the benefit of Italian patent application No. 102018000007680 filed on Jul. 31, 2018, the disclosure of which is incorporated herein by reference

TECHNICAL FIELD

The present invention relates to an inductive-humidification and evaporative-cooling ventilation system and in particular to a supersaturation inductive-humidification and evaporative-cooling ventilation system where the water introduced is effectively distributed in a flow of hot air recalled into the proximity of the water diffusers in order to facilitate absorption of the water.

BACKGROUND

Forming part of the known technology is adiabatic treatment of external air introduced into an environment for controlling the hygrometric conditions. These systems have been adopted for decades, in particular, in the textile sector, where high rates of humidity are necessary for the manufacturing process.

The systems so far adopted may be divided into systems where saturated air is introduced into the environment and systems where supersaturated air is introduced into the environment.

In saturated-air systems, the treatment air is taken in from outside with respect to the treated environment and is humidified by setting it in contact with water.

The humidification systems used are extremely varied, and the following may be listed:

Recirculating-water sprinkler chambers: the flow of air is introduced into purposely provided chambers where the air comes into contact with a large amount of water sprayed by nozzles at low pressure (<3 bar); before leaving the humidification chamber, a series of profiles arranged to form a serpentine path stops the excess water not absorbed by the air.

High-pressure saturation chambers: the flow of air is introduced into purposely provided chambers where the air comes into contact with water finely nebulised by nozzles operating at high pressure (>40 bar) or operating with water/compressed air to obtain optimal micronisation; also for these systems, before leaving the humidification chamber, a series of profiles arranged to form a serpentine path stops the excess water not absorbed by the air; and Honeycomb-pad humidifiers: the air passes through special panels, normally provided as plates made of cellulose fibre and having hexagonal honeycomb channels, which are constantly sprayed and soaked with water; as the air flows, by coming into physical contact with the pad, it absorbs the water present therein; the speeds of the air passing through are contained in order to prevent water not absorbed from being entrained downflow and render unnecessary any further drop-arresting profiles.

Supersaturation systems, which adopted in particular in the textile industry, envisage nebulisation of the water inside air-and-water distribution channels specifically designed for this purpose.

Immediately following upon entry of the air into the channel, different air-nebulisation systems (of a low-pressure type, a high-pressure type, or centrifugal type) supply the amount of water to the air to be treated.

Since the distribution duct is completely sprayed with water, it is purposely designed so that it is able to ensure collection of the condensate and absence of dripping by providing a water-collection gutter set underneath it, which also has the function of distributing supersaturated air into the room being treated.

The above system allows values of supersaturation of up to around 1 g per kilogram of air. In the environment saturated air is diffused together with a water aerosol, which, by absorbing the ambient heat, evaporates directly in the environment.

Both of the humidification systems referred to above present problems that today remain unsolved.

No system has a humidification efficiency that is capable of making the treated air absorb the entire amount of water introduced, always rendering necessary draining systems, with consequent possible stagnation of water.

Present in the distribution ducts is air at extremely high saturation levels, which easily triggers condensation, with corrosion of the ducts and bacterial proliferation.

Also in the case of supersaturation systems, it is not possible to provide the air being treated with a significant amount of water (higher than 1 g per kilogram of treated air), without incurring in condensation and dripping.

SUMMARY

The aim of the present invention is to provide a humidification and evaporative-cooling ventilation system that overcomes the drawbacks of the prior art.

Another aim is to provide a system that will eliminate the problems linked to conveying saturated air or water within the distribution ducts.

A further aim is to provide a system that will eliminate the deposits and any return of non-absorbed water.

Yet another aim is to provide a system that will be able to increase the supersaturation capacity.

According to the present invention, the above aims and others still are achieved by an inductive-humidification and evaporative-cooling ventilation system, which comprises: means for generating a flow of air; a channel for conveying said flow of air, said channel comprising a plurality of inductive holes for transferring said flow of air into the environment, and said channel further comprising at least one outflow mouth for expelling said flow of air, which has a three-dimensional structure open both at the back and at the front, and a fluid-thread straightener set at the rear end of said at least one outflow mouth, which recalls a flow of air from the environment surrounding said channel; and at least one humidification device for introducing nebulised water into the environment; wherein said at least one humidification device is set inside said at least one diffusion mouth, and said plurality of holes are arranged in a number of rows aligned longitudinally along the ducts.

Further characteristics of the invention are described in the dependent claims.

The advantages of the present solution as compared to the solutions of the prior art are various.

The system is based upon adiabatic treatment of the air, namely, upon the capacity of the evaporating water to transform the sensible heat of the air into latent heat of vaporization, without on the other hand changing the total thermal content thereof (isenthalpic treatment).

In particular, the aim of the system is to control the temperature and humidity of an environment by means of supersaturated air introduced with a system that uses completely dry ducts for diffusion of air of an inductive type into an environment and a system for introducing nebulised water directly into the flow of induced air but protected in a secondary flow capable of ensuring complete absorption of the water, without any condensation or dripping.

The outflow mouth impresses on the air, at outlet, a perfectly laminar motion that protects humidification and consequently determines the directionality of the flow of humidified air towards the environment.

BRIEF DESCRIPTION OF THE DRAWINGS

The characteristics and advantages of the present invention will emerge clearly from the ensuing detailed description of a practical embodiment thereof, illustrated by way of non-limiting example in the annexed drawings, wherein.

DETAILED DESCRIPTION

Figure 1:
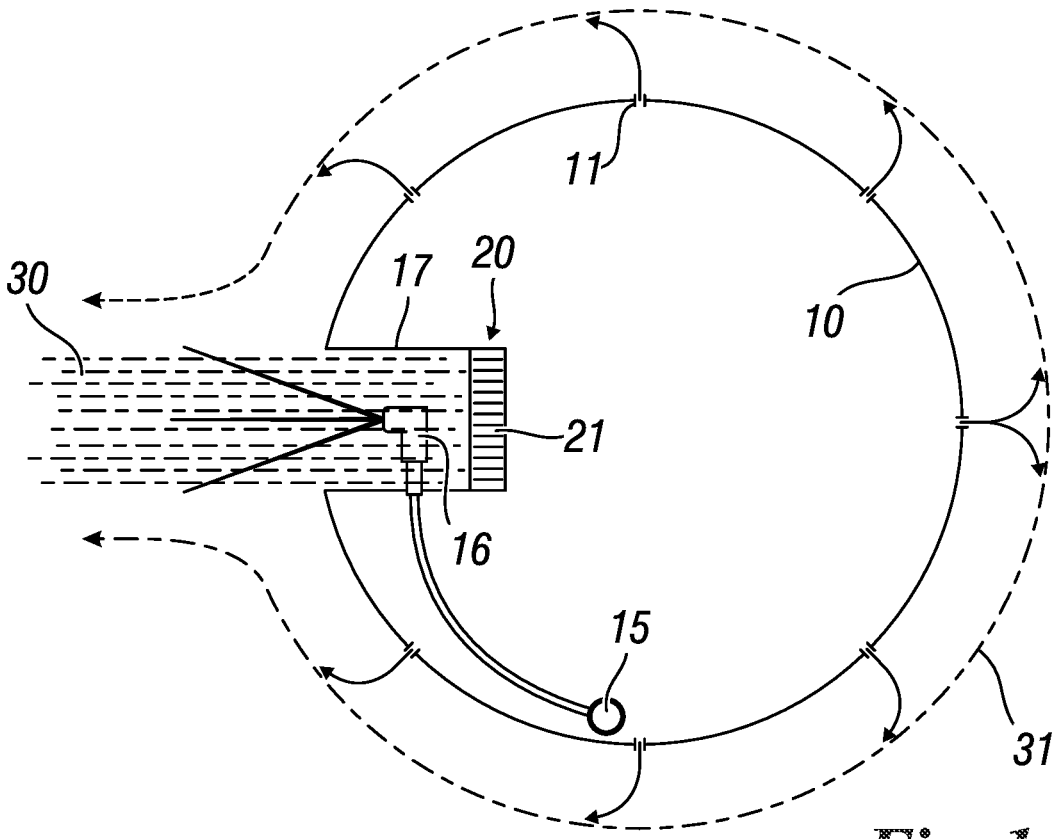
FIG. 1 is a schematic sectional view of a duct of an inductive-humidification and evaporative-cooling ventilation system, shown in sectional view, according to the present invention.
Figure 2:
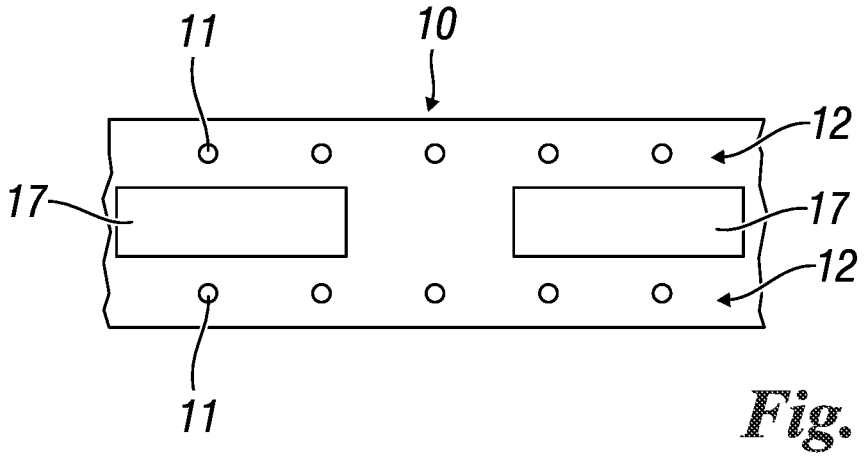
FIG. 2 is a schematic front view of a duct of an inductive-humidification and evaporative-cooling ventilation system, shown in front view, according to the present invention.

With reference to the attached figures, an inductive-humidification and evaporative-cooling ventilation system according to the present invention comprises means for generation of a flow of air, not shown, obtained in a known way, for example with ventilation fans.

Associated to the air-flow generation means is an air-diffusion system, which is made up of various channels 10 or ducts, for sending the air into the environment.

The ducts 10 are generally formed by metal pipes with circular or square section.

In order to trigger the inductive effect, the ducts 10 have a plurality of diffusion holes 11 aligned longitudinally along the ducts 10.

The holes 11 may even have dimensions different from one another.

In particular, a number of aligned rows 12 of holes 11, preferably parallel to one another, are provided along the ducts 10.

For instance, seven rows 12 of holes 11 may be provided and, considering the section of the duct 10, the rows 12, starting from 0° at the top of the duct 10 and turning in a clockwise direction, are positioned every 45°, except for the angle 270°, where they are missing, or else three rows 12 of holes 11 may be provided every 90° except for the angle 270°. Any other number of rows 12 of holes 11 is possible according to the needs.

The holes 11 for diffusion of the air into the environment are characterised by an air-outlet speed such as to generate localised microturbulence and consequent areas of negative pressure, a well-known inductive effect that recalls air from the environment towards the outer surface of the ducts 10.

The size, density, and positions of the holes must be such as to generate an inductive effect (recall of air) equal to or greater than 1:10: considering a flow rate of pressurised air from the duct of 10 $m^3/h$, the air recalled from the environment into its proximity must be greater than 100 $m^3/h$.

The position corresponding to the angle 270° represents the front part of the duct 10, i.e., the side that faces the environment to be cooled, whereas the position corresponding to the angle 90° is normally at the back, against a wall, if the duct is positioned against a wall of the environment.

Consequently, the holes 11 for inductive recall of the ambient air into the proximity of the duct 10 are modified and symmetrical with respect the axis of the duct in the case where the air-delivery duct is set at the centre of the environment.

To cool the air, humidification systems are used, in combination with diffusion of the air, which are able to introduce atomised or nebulised drops of water into the air.

The humidification system comprises one or more ducts 15 for conveying the water, in a constrained manner along the ducts 10, and a plurality of delivery nozzles 16 for delivering the nebulised water.

According to the present invention, set in the position of the ducts 10 previously defined by the angle 270°, where the holes 11 are not present, is a plurality outflow mouths 17, which are typically rectangular.

The outflow mouths 17 are positioned along the ducts 10, preferably horizontally and orientated towards the environment to be humidified/cooled so as to supply a flow of air into the environment.

According to an embodiment, the outflow mouths 17 consist of three-dimensional structures with rectangular section recessed within the ducts 10 and open both at the back and at the front.

Present on the rear end 20 of the outflow mouth 17, and hence the end on the inside of the duct 10, is a fluid-thread straightener 21.

The front end of the outflow mouth 17 is flush with the edge of the duct 10.

Alternatively to what is described and represented in the figures, the outflow mouths 17 may be made with sections having different shapes, for example circular or some other shape. They can moreover project, either partially or completely, from the ducts 10, instead of being provided inside them.

The fluid-thread straightener 21 consists of a honeycomb structure, hence a structure with cells having a hexagonal section joined together, or else, alternatively, the cells are obtained with elements with circular section. The size of the fluid-thread straightener 21 is equal to the size of the rear opening of the outflow mouth 17.

In an example of embodiment of the present invention, with ducts 10 having a diameter of between 1100 and 600 mm, an outflow mouth 17 is 750 mm long and 200 mm high and is recessed within the duct 10 by approximately 120 mm, the fluid-thread straightener 21 is 30 mm deep (in any case, with a depth comprised between 10 and 100 mm) and its cells have a typical diameter of 5 mm, the holes 11 have a diameter of 5-16 mm, and the pressure of the air inside the inductive duct is 100 Pa.

The depth of the fluid-thread straightener 21 is in any case sized to impart a flow that is as laminar and rectilinear as possible on the air.

According to the present invention, the nozzles 16 (which are one or more according to the needs) are located inside the outflow mouths 17, with the outlet hole set at one half of the height of the outflow mouth 17 and directed towards the environment, and are positioned in front of the fluid-thread straightener 21 and at approximately one half of the depth of the outflow mouth 17.

The nozzles 16 are used for introducing nebulised water into the laminar flow of air directed from the outflow mouth 17 towards the environment.

Hence, the outflow mouth 17 is set at the front of the duct 10, in a horizontal position, while the rows 12 of holes 11 are arranged around the duct 10, in a vertical position at the top and at the bottom, in a rear horizontal position, and in positions intermediate between the aforesaid positions. Also rows 12 of holes 11 could be set in a front horizontal position in the space between one mouth 17 and the other 17.

The purpose of the outflow mouths 17 is dual.

They impress directionality on the flow of air 30 coming from the duct 10 and recall the flow of air 31, from the environment surrounding the duct 10, coming from the holes 11 and from the air induced by them, and orientate it in a specific direction, represented by the primary flow of the mouth 17.

They moreover protect the flow of nebulised water coming from the nozzle 16 from any turbulence generated by the flow of air 31 recalled by the holes 11.

In fact, the air from the ducts 10 passes into the fluid-thread straightener 21 and then into the outflow mouths 17, intercepts the nozzles 16, and comes out as air flow 30 into the environment.

It is in fact well known that a flow of finely nebulised water sprayed in a turbulent and disorderly flow of air (as is a flow of induced air) loses a fair share of its efficacy of evaporation. The microdrops, agitated and brought into contact with one another by the turbulent motion of the air, coalesce, increase in size, and consequently precipitate, given that, owing to the increase in size, they undergo natural evaporation with greater difficulty.

The nebulisation nozzle 16 operates, instead, in a protected air channel generated by the outflow mouths 17, with an accompanying laminar air flow such as not to disturb or agitate the atomisation produced, its efficiency hence remaining unaltered up to complete absorption by the surrounding air.

It is moreover to be noted that the air surrounding the nebulised water is not, as in the case of conventional adiabatic humidification systems, the only one introduced by the air-diffusion mouths, but is the sum of this amount and the total ambient air 31 recalled, via the flow coming from the outflow mouth 17, by the holes 11, which is equal to at least ten times the amount of air expelled.

It is a physical fact that the maximum amount of water that air can absorb as a result of vaporisation is limited by precise thermo-hygrometric conditions of the air itself. Once the value of 100% relative humidity (RH) has been reached, the air is in fact no longer able to absorb further water, which, remaining in the liquid state, will precipitate to the ground, without performing any further humidification function.

Purely by way of example, one kilogram of air at the initial conditions of 30° C. with 40% RH and already containing 10.5 g of water in the form of vapour is able to absorb at the most a further 4 g before reaching saturation (100% RH), beyond which any further amount of water introduced can no longer be absorbed and will precipitate in the liquid state.

In the case of the present invention, the water-nebulisation nozzle 16 is protected, and the diffusion of nebulised water is accompanied by the laminar flow of air into a flow of recalled air equal to ten times that of the normal working, said flow of recalled air being given by the air delivered by the outflow mouth 17 plus the air recalled in its proximity by the air coming out of the holes 11.

Given the same conditions of the example referred to above, the system is able to supply to the environment up to 40 g of water per kilogram of air delivered by the outflow mouth 17, a maximum humidification capacity higher than ten times that of a conventional system.

Without the need to push to the limit of saturation, the system is hence able to ensure an extremely high humidification capacity in total safety, remaining far from the curve of saturation and hence precipitation of water.

The amount of water introduced into the environment is calibrated in a way proportional to the demand for humidity of the environment itself. Regulation of the exact amount introduced is obtained by varying the pressure of water supplied to the nozzle/nozzles and preferably, though not necessarily, by varying also the amount of expelled air.

It is, however, known that each water-nebulisation nozzle, of whatever type and constructional form, loses efficiency as the supply pressure drops. In particular, below a precise value determined by the constructional characteristics of the nozzle itself, the nebulisation efficiency drops drastically, and water atomisation deteriorates until particles of water not sufficiently atomised to be absorbed by the air are produced, thus causing dripping.

The nozzle is preferably provided with an automatic shut-off valve constituted by a calibrated spring and by an open/close element for shutting the supply duct: below a pre-set pressure value (higher than the minimum pressure of nozzle efficiency) the spring will push the open/close element to close.

During automatic control of the humidity, as the flow rate of water decreases and consequently also the supply pressure, the valve inserted upstream of the nebulisation nozzle closes the circuit, the pump is excluded, and the supply-water circuit is de-pressurised instantaneously by means of sudden opening of the pressure-relief point.

The invention claimed is:

1. An inductive-humidification and evaporative-cooling ventilation system comprising: means for generation of a flow of air; a channel (10) for conveying said flow of air, said channel (10) comprising a plurality of inductive holes (11) for transferring said flow of air into the environment, said channel (10) further comprising at least one outflow mouth (17) for expelling said flow of air, having a three-dimensional structure open both at the back and at the front, and a fluid-thread straightener (21) set at the rear end of said at least one outflow mouth (17), which impresses directionality on the flow of air coming from the channel (10), the outflow mouth recalling a flow of air (31) from the environment surrounding said channel (10); and at least one humidification device (16) for introducing nebulised water into the environment; wherein said at least one humidification device (16) is set within said at least one outflow mouth (17), and said plurality of holes (11) are arranged in a number of rows (12) aligned longitudinally along the channel (10);

wherein the at least one humidification device (16) has the outlet hole for nebulised water directed towards the environment and the at least one humidification device (16) is set in front of the fluid-thread straightener (21).

2. The system according to claim 1, characterised in that said fluid-thread straightener (21) consists of a honeycomb structure with hexagonal cells or a structure with circular cells.

3. The system according to claim 1, characterised in that said fluid-thread straightener (21) has a size equal to the size of the rear opening of said outflow mouth (17).

4. The system according to claim 1, characterised in that said fluid-thread straightener (21) has a depth ranging between 10 and 100 mm.

5. The system according to claim 1, characterised in that the outflow mouth (17) has a rectangular section.

6. The system according to claim 1, characterised in that the outflow mouth (17) has a circular section.

7. The system according to claim 1, characterised in that said outflow mouth (17) is recessed within said channel (10).

8. The system according to claim 1, characterised in that said rows (12) of holes (11) are distributed around the channel (10), so that the air coming out of said holes (11) recalls by induction the environmental air into the proximity of the duct.

9. The system according to claim 1, characterised in that said outflow mouth (17) recalls a flow of air (31) coming from said holes (11) and from the air induced by them, directing it in a specific direction, represented by the primary flow of the mouth (17).

10. The system according to claim 1, characterised in that said outflow mouth (17) is set in a horizontal position; and said rows (12) of said pluralities of holes (11) are arranged in a vertical position upwards and downwards and in a rear horizontal position.

* * * * *